US005765687A

United States Patent [19]

Matsubara et al.

[11] Patent Number: 5,765,687

[45] Date of Patent: Jun. 16, 1998

[54] PACKING CASE FOR HONEYCOMB STRUCTURES

[75] Inventors: Masaaki Matsubara, Okazaki; Ken Matsudo; Yukio Kobayashi, both of Nagoya, all of Japan

[73] Assignee: NGK Insulators, Ltd., Nagoya, Japan

[21] Appl. No.: 804,375

[22] Filed: Feb. 21, 1997

[30] Foreign Application Priority Data

Feb. 29, 1996 [JP] Japan ..... 8-043360

[51] Int. Cl.[6] ..... B65D 81/02

[52] U.S. Cl. ..... 206/521; 206/564; 206/589; 229/120.37

[58] Field of Search ..... 206/521, 562, 206/564, 588, 589; 229/120.33, 120.34, 120.37

[56] References Cited

U.S. PATENT DOCUMENTS

| | | | |
|---|---|---|---|
| 1,812,311 | 6/1931 | Wolf | 206/589 |
| 2,665,049 | 1/1954 | George | 229/120.34 |
| 3,228,518 | 1/1966 | Coby | 206/589 |
| 3,682,597 | 8/1972 | Husch | 206/589 |
| 4,294,358 | 10/1981 | Nauheimer et al. | 206/589 |
| 4,512,511 | 4/1985 | Zimmermann | 229/120.33 |
| 4,624,032 | 11/1986 | Yacknut et al. | 206/589 |

FOREIGN PATENT DOCUMENTS

| | | | |
|---|---|---|---|
| 0 386 280 A1 | 9/1990 | European Pat. Off. . | |
| 2269365 | 2/1994 | United Kingdom | 206/589 |

*Primary Examiner*—David T. Fidei

*Attorney, Agent, or Firm*—Kubovcik & Kubovcik

[57] ABSTRACT

A packing case for honeycomb structures is constituted by a case and a honeycomb structures-holding plate accommodated inside the case. The case is constituted in one piece by at least a bottom plate and side plates, and the honeycomb structures-holding plate is constituted by a honeycomb structures-holding portion, legs and slippage-preventing portions. The honeycomb structures-holding portion has a plurality of holes for holding honeycomb structures and is provided at about the same height as the vertical-direction center of the side plates of the case in such a manner that the portion is parallel to the bottom plate of the case and abuts against the side plates of the case. The legs are provided at the two opposing sides of the honeycomb structures-holding portion vertically and downward along the side plates of the case facing the two opposing sides, and the slippage-preventing portions are provided at the other two opposing sides of the honeycomb structures-holding portion vertically and upward along the side plates of the case facing the other two opposing sides.

7 Claims, 5 Drawing Sheets

FIG.4(A)
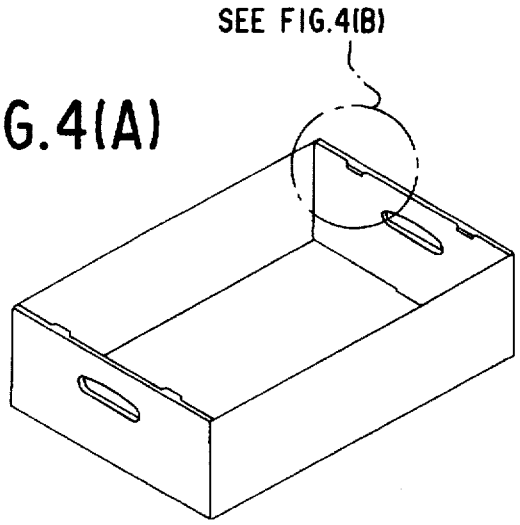
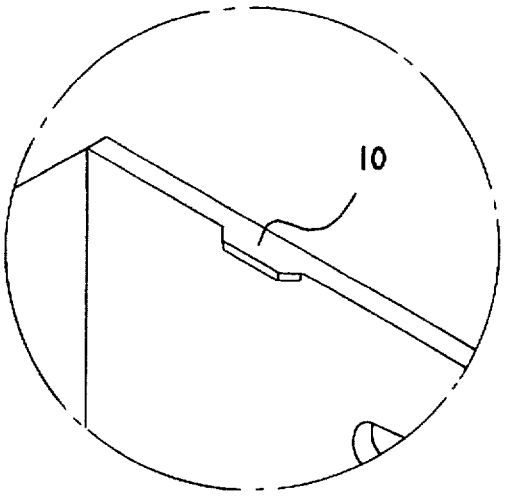
FIG.4(B)
FIG.4(C)
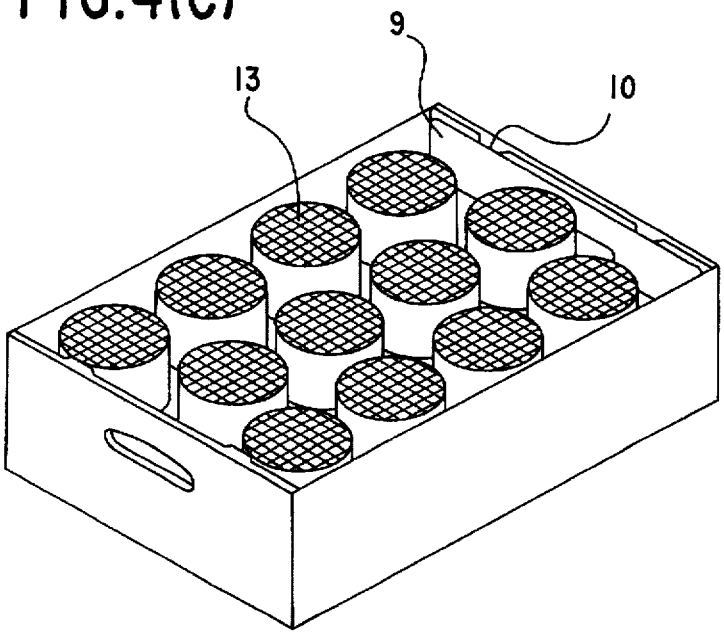

PACKING CASE FOR HONEYCOMB STRUCTURES

BACKGROUND OF THE INVENTION

1. Field of the Invention

The present invention relates to a packing case for honeycomb structures, used for packing, storage and transfer of honeycomb structures.

2. Description of the Prior Art

Honeycomb structures are in wide use, for example, as a catalyst carrier or an exhaust gas filter in the exhaust gas purification system of an automobile. Honeycomb structures used as a catalyst carrier show, for their high porosity, a low pressure loss when an exhaust gas is passed therethrough, and accordingly show an excellent exhaust gas purification ability and are in wide use. Honeycomb structures in actual use have, for example, a cell wall thickness of 0.150 mm and a cell density of 60/cm$^2$. Currently, honeycomb structures having a slighter (thinner) cell wall thickness and a higher cell density are needed.

Honeycomb structures have a slighter cell wall thickness and are made mainly of a ceramic which is a fragile material. Therefore, the packing of honeycomb structures must be conducted in such a manner that the honeycomb structures are not broken due to the impact, slippage, collapse, etc. which they undergo during packing, storage, transfer, etc.

The packing of honeycomb structures used as a catalyst carrier has been conducted, for example, as shown in FIG. 5(A). On the bottom of a corrugated paper case (not shown) is placed a plastic tray 21 having a plurality of indentation 25 which well fit each end of honeycomb structures 13 to be packed, in a manner that the indentation 25 are directed upward; honeycomb structures 13 to be used as a catalyst carrier are placed on the indentation 25; on the honeycomb structure 13 is placed another plastic tray 21 having the same shape as the above-mentioned plastic tray 21. Incidentally, the corrugated paper case may have no lid.

The packing of honeycomb structures, to be used as a catalyst carrier, has alternatively been conducted by dividing the inside of a corrugated paper case (not shown) or a plastic returnable container (not shown) with partitions 23 made of a corrugated paper and used for packing a fragile article, as shown in FIG. 5(B), and accommodating, in each division formed, a honeycomb structure 13 to be used as a catalyst carrier.

In storing or transferring honeycomb structures by packing them in cases, the cases are often piled in a plurality of layers. Therefore, when the cases are corrugated paper cases each having a lid, the bottom of one case comes in contact with the lid of other cases placed therebeneath. When the cases are corrugated paper cases having no lid as mentioned above, the upper plastic tray placed in one corrugated paper case comes in contact with the bottom of another corrugated paper case placed thereon. In such multi-layer piling, since the frictional resistance of the above-mentioned contact area between upper and lower cases is small, the piled cases give rise to slippage, collapse and/or slipping-down; as a result, there sometimes occurs breakage of honeycomb structures contained in packing cases, for example, chipping-off of the honeycomb structures.

Honeycomb structures are generally transferred from the manufacturer to a primary processor and a secondary processor and further to users. Whenever the honeycomb structures are transferred from the manufacturer to a primary processor and a secondary processor, packing and unpacking are conducted.

In unpacking, a packing case as shown in FIG. 5(A) containing upper and lower plastic trays 21, the upper plastic tray 21 and the case need to be separated, which has made the unpacking operation troublesome and has made the operational efficiency low. In a packing mode as shown in FIG. 5(B) using corrugated paper partitions in a corrugated paper case, a plurality of operational steps are needed in placing the partitions in the case and, moreover, the partitions tend to be deformed or disassembled during packing or unpacking; thus, the operability has been poor.

OBJECT AND SUMMARY OF THE INVENTION

The present invention has been made with an aim of providing a packing means for honeycomb structures, which is free from the above-mentioned problems of the prior art, which is easy to handle, which causes no breakage of honeycomb structures packed therein even when there is vibration during transfer thereof, and which is produced at a low cost.

According to the present invention there is provided a packing case for honeycomb structures, constituted by a case and a honeycomb structures-holding plate accommodated inside the case, wherein the case is constituted in one piece by at least a bottom plate and side plates, the honeycomb structures-holding plate is constituted by a honeycomb structures-holding portion, legs and slippage-preventing portions, the honeycomb structures-holding portion has a plurality of holes for holding honeycomb structures and is provided at about the same height as the vertical-direction center of the side plates of the case in such a manner that the portion is parallel to the bottom plate of the case and abuts against the side plates of the case, the legs are provided at the two opposing sides of the honeycomb structures-holding portion vertically and downward along the side plates of the case facing the two opposing sides, and the slippage-preventing portions are provided at the other two opposing sides of the honeycomb structures-holding portion vertically and upward along the side plates of the case facing the other two opposing sides.

BRIEF DESCRIPTION OF THE DRAWINGS

FIG. 3(A) is a spread view, and FIG. 3(B) is a perspective view.

FIG. 4(A) is a perspective view showing an example of the case constituting the present packing case for honeycomb structures; FIG. 4(B) is an enlarged fragmentary view showing the relation between slippage-preventing portion and stoppers, and FIG. 4(C) is a perspective view showing another example of the state in which honeycomb structures are packed in the present packing case for honeycomb structures.

DETAILED DESCRIPTION OF THE INVENTION

Figure 1:
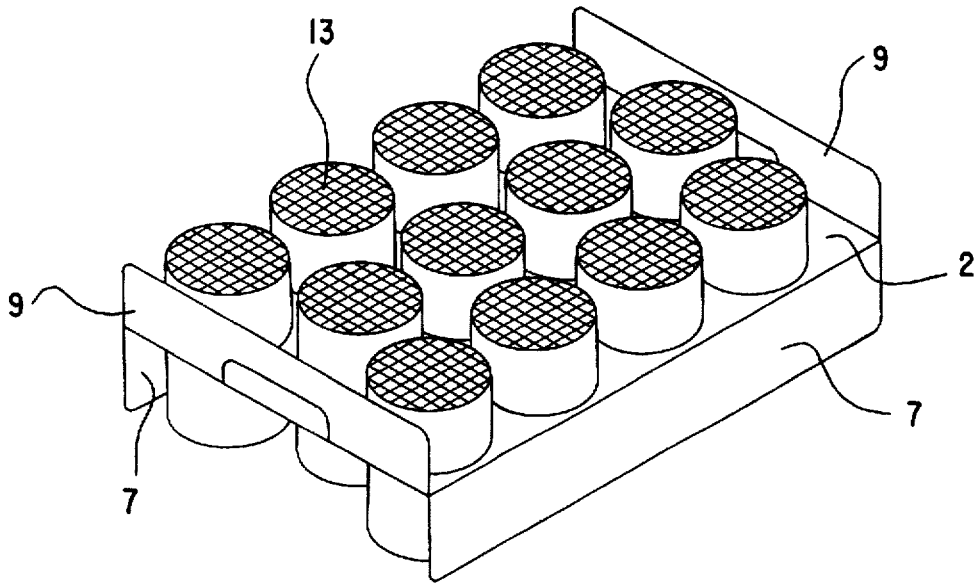
FIG. 1 is a perspective view showing an example of the honeycomb structures-holding plate constituting the present packing case for honeycomb structures.

In the present packing case for honeycomb structures, it is preferable that the lower ends of the legs of the honeycomb structures-holding plate are in contact with the bottom plate of the case, because with such a constitution, the honeycomb structures-holding portion of the honeycomb structures-holding plate can be fixed at a position at which the portion is most stabilized, regardless of the size of each honeycomb structure to be held by the portion. It is not necessary that the whole surface of the lower end of each leg is in contact with the bottom plate, and each lower end may have a notch(es).

In the present packing case for honeycomb structures, it is also preferable that at least part of the upper end of each slippage-preventing portion of the honeycomb structures-holding plate is at about the same height as the upper ends of the side plates of the case, because with such a constitution, when the present packing case is piled in a plurality of layers, the bottom plate of one packing case can press the upper end of each slippage-preventing portion of other packing case placed beneath the former packing case and thereby the position of the honeycomb structures-holding portion of the latter packing case can be fixed.

It is also preferable that the case has, at the upper end of each side plate facing each slippage-preventing portion of the honeycomb structures-holding plate, at least one stopper which protrudes toward the inside of the case and whose lower surface abuts against the upper end of each slippage-preventing portion, because with such a constitution, the vertical and upward slippage of the honeycomb structures-holding plate in the case can be prevented.

Each stopper may abut against the whole surface of the upper end of the slippage-preventing portion, or the stopper and the upper end of the slippage-preventing portion may each have a notch(es) so as to enable their fitting.

In the present packing case for honeycomb structures, it is also preferable that the upper surface of the stopper is at the same height as or lower than the upper end of the side plate of the case. It is also preferable that the upper ends of the honeycomb structures held in the present packing case are at the same height as or higher than the upper ends of the side plates of the case. These constitutions are advantageous when the present packing case is piled in layers. As long as the upper ends of the honeycomb structures are higher than the upper ends of the side plates of the case, the same packing case can be used for honeycomb structures of any heights.

In the present packing case for honeycomb structures, it is also preferable that both the case and the honeycomb structures-holding plate are made of a corrugated paper, and it is also preferable that the honeycomb structures-holding plate is made of a sheet of corrugated paper in one piece.

The packing case for honeycomb structures according to the present invention is described with reference to FIGS. 1 to 4(A), 4(B).

Figure 3A:
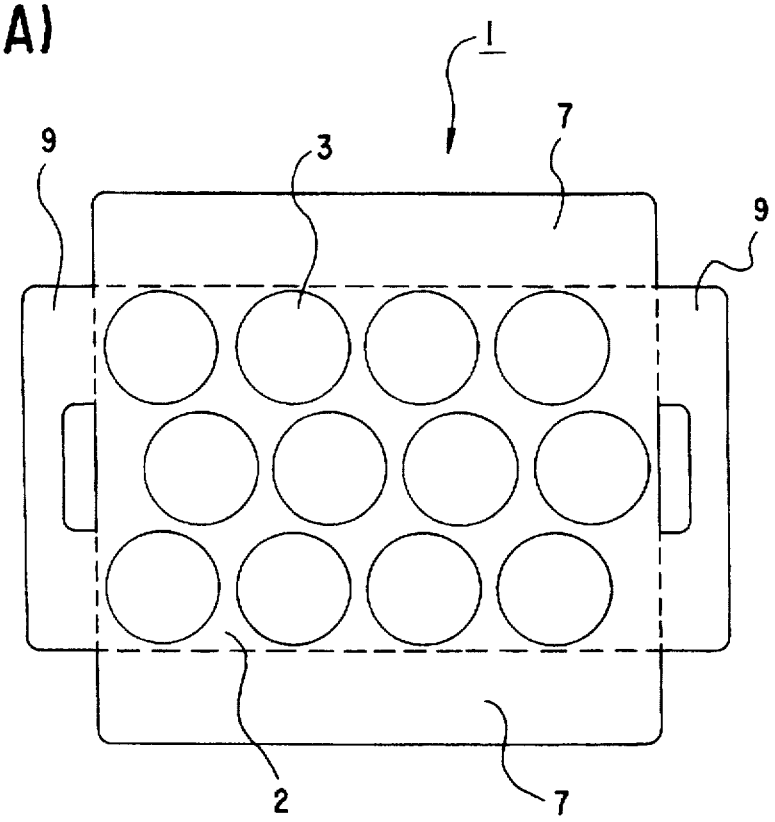
FIGS. 3(A) and 3(B) show an example of the honeycomb structures-holding plate constituting the present packing case for honeycomb structures.

FIG. 3(A) is an example of the spread view of the honeycomb structures-holding plate 1 constituting the present packing case for honeycomb structures. The honeycomb structures-holding plate 1 may be made of a corrugated paper, a pulp molding, a plastic or the like, but is preferably made of a corrugated paper because the plate 1 constituted by honeycomb structures-holding portion 2, legs 7 and slippage-preventing portions 9 can be easily produced from a sheet of corrugated paper in one piece by cutting and bending.

When the present packing case is used as a returnable container or for long-distance transportation, the honeycomb structures-holding plate may be produced from a pulp molding, a plastic or the like in one piece by press molding or injection molding, or may be produced by extruding or bonding of individual parts each made of a high-strength plastic.

Figure 3B:
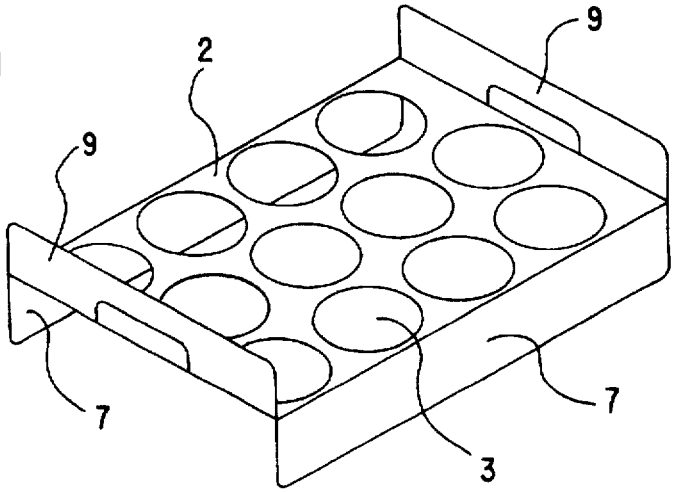

FIG. 3(B) is a perspective view showing an assembled honeycomb structures-holding plate 1 to be accommodated in the case of the present packing case. In the honeycomb structures-holding portion 2 of the plate 1 are formed a plurality of holes 3 for holding honeycomb structures, which well fit the shape of one end of each honeycomb structure to be packed. Herein, "honeycomb structure" refers to a member made of a ceramic, a metal or the like (all having a large number of small throughholes), having a sectional shape such as rectangle, hexangle or the like and is used, for example, as a catalyst carrier, an exhaust gas filter, a heat exchanger, etc.

Figure 2A:
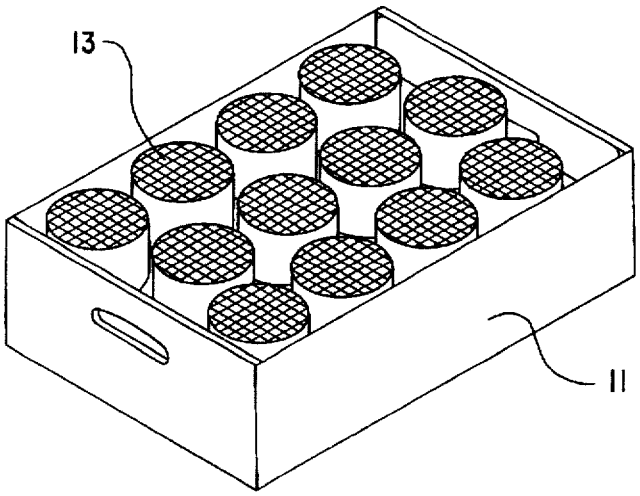
FIG. 2(A) is a perspective view showing an example of the state in which honeycomb structures are packed in the present packing case for honeycomb structures.
Figure 2B:
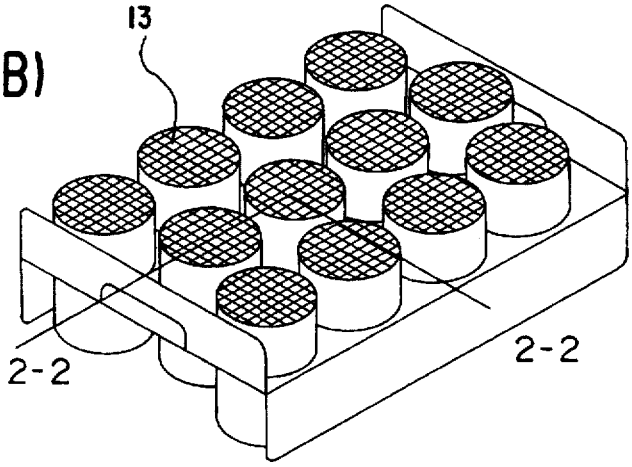
FIG. 2(B) is a perspective view showing a state in which, in FIG. 2(A), the case of the packing case is removed.

FIG. 2(B) is a perspective view showing a state in which honeycomb structures 13 are fit into the holes 3 for holding honeycomb structures, of the honeycomb structures-holding plate 1 mentioned in FIGS. 3(A) and 3(B). The honeycomb structures-holding plate 1 has legs 7 extending from the two opposing sides of the honeycomb structures-holding portion 2 vertically and downward along the two side walls of a case 11 facing said two sides, whereby the honeycomb structures-holding portion 2 can be fixed parallel to the bottom plate of the case 11 at about the same height as the vertical-direction center of the honeycomb structures 13, preferably at a position of the honeycomb structures ¼ to ¾ upward from the bottom plate of the case 11.

FIG. 2(A) is a perspective view showing a state in which the above honeycomb structures-holding plate 1 is accommodated in a case 11.

Figure 2C:
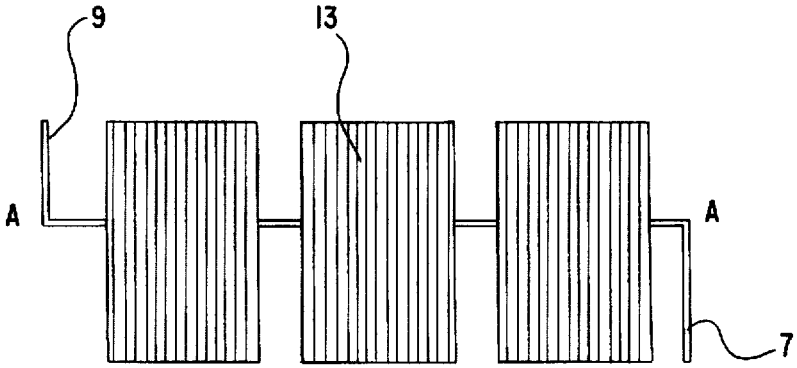
FIG. 2(C) is a sectional view taken at the 2—2 line of FIG. 2(B).

FIG. 2(C) is a sectional view taken at the 2—2 line of FIG. 2(B) and shows the positional relation in vertical direction between honeycomb structures-holding portion 2, legs 7 and slippage-preventing portions 9.

The legs 7 are formed at the two opposing sides of the honeycomb structures-holding portion 2 of the honeycomb structures-holding plate 1 in one piece with the portion 2, and extend vertically and downward from the two sides with the lower ends abutting against the bottom plate of the case 11. The slippage-preventing portions 9 are formed at the two other opposing sides of the honeycomb structures-holding portion 2 of the honeycomb structures-holding plate 1 in one piece with the portion 2, and extend vertically and upward from the two sides with the upper ends being in the vicinity of the upper end of the case 11. By employing such a constitution, the honeycomb structures-holding plate 1 can have an increased rigidity and is free from vertical movement.

When the present packing case is piled in a plurality of layers, on one case (a lower case) 11 is directly placed other case (an upper case) 11 without placing any medium (e.g. a corrugated paper) between the two cases. Consequently, the bottom plate (made of a corrugated paper) of the upper case 11 comes in contact with the upper surfaces of the honeycomb structures 13 in the lower case 11, and slippage is unlikely to occur and the honeycomb structures 13 can be stored and transferred in a stable condition.

FIGS. 4(A) and 4(B) show another embodiment of the present packing case. FIG. 4(A) is a perspective view and FIG. 4(B) is an enlarged fragmentary view, both showing the relation between slippage-preventing portion and stoppers 10. FIG. 4(C) is a perspective view showing that each stopper 10 is formed at the top and inside of each side plate of the case facing each slippage-preventing portion 9 of the honeycomb structures-holding plate.

When the case is made of a corrugated paper, each stopper 10 can be formed by producing each side plate of the case facing each slippage-preventing portion 9 of the honeycomb structures-holding plate 1, in a double-layer structure of side plate of the present packing case, and bending the upper end of the inner layer inwardly. In other embodiment, each stopper 10 can be formed by making a cut(s) in the upper end of the inner layer of the above-mentioned double layer structure and bending the cut portion(s) inwardly.

The upper surface of each stopper 10 is desirably at the same height as the upper surfaces of the honeycomb structures 13 fitted into the holes 3 of the honeycomb structures-holding portion, because when the present packing case is piled in layers, the load applied downward from an upper packing case can be uniformly supported by the upper surfaces (which are most resistant to the load) of the honeycomb structures 13 contained in a lower packing case and there appears to be no movement in packing cases during transfer.

The present invention is hereinafter described in more detail by way of an Example and Comparative Examples. However, the present invention is not restricted to the

EXAMPLE 1

In a packing case for honeycomb structures, accommodating a honeycomb structures-holding plate as shown in FIG. 1 were packed 12 honeycomb structures, as shown in FIG. 2(A). Then, evaluation was made on various items. The results are shown in Table 1. In Table 1, o indicates "excellent"; Δ indicates "good"; and X indicates "acceptable".

Comparative Example 1

Figure 5A:
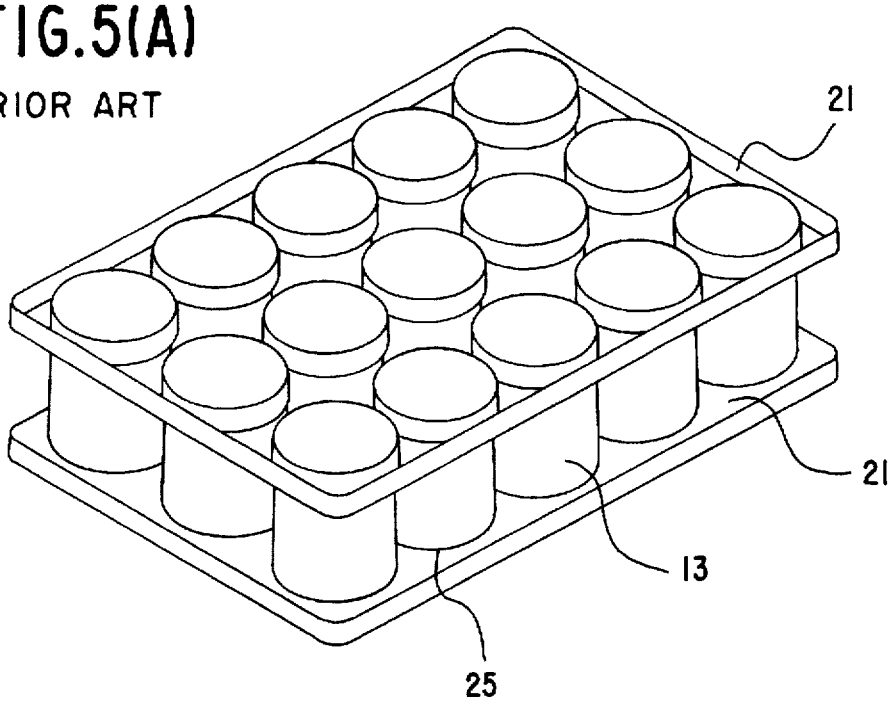
FIG.5(A) PRIOR ART
FIG. 5(A) is a perspective view showing an example of the honeycomb structures-holding tray constituting the conventional packing cases for honeycomb structures.

15 honeycomb structures were packed in a corrugated paper case using plastic trays 21 shown in FIG. 5(A). Then, evaluation was made on various items. The results are shown in Table 1.

Comparative Example 2

Figure 5B:
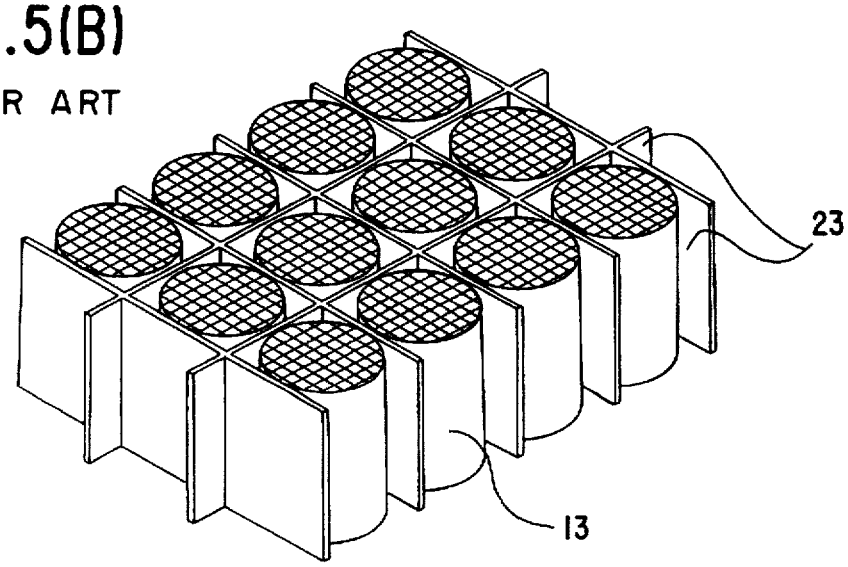
FIG.5(B) PRIOR ART
FIG. 5(B) is a perspective view showing another example of the honeycomb structures-partition constituting the conventional packing cases for honeycomb structures.

12 honeycomb structures were packed in a corrugated paper case using corrugated paper partitions 23 shown in FIG. 5(B). Then, an evaluation was made on various items. The results are shown in Table 1.

TABLE 1

| | Interior packaging material | | |
|---|---|---|---|
| | Present invention | Conventionally used | |
| | Honeycomb structures-holding plate | Plastic trays | Corrugated paper partitions |
| Basic properties | | | |
| Slippage of interior packaging material | o | o | o |

TABLE 1-continued

| | Interior packaging material | | |
|---|---|---|---|
| | Present invention | Conventionally used | |
| | Honeycomb structures-holding plate | Plastic trays | Corrugated paper partitions |
| Contact between honeycomb structures | o | o | o |
| Deformation of interior packaging material | o | o | o |
| Features | | | |
| Resistance to slippage or/and collapse of honeycomb structures | o | x | Δ |
| Number of parts used for packing of honeycomb structures | o | Δ | x |
| Handleability | o | Δ | x |
| Cost | o | x | Δ |
| Disposability when packing case becomes non-usable | o | x | o |
| Space required for storage of interior packaging material | o | Δ | x |

The packing case for honeycomb structures according to the present invention is easy to handle, causes no breakage of honeycomb structures packed therein occurs even when there is vibration during transfer thereof, and gives rise to no slippage or collapse of honeycomb structures packed therein even when piled in a plurality of layers.

Since the honeycomb structures-holding plate of the present packing case comprising a honeycomb structures-holding plate, legs and slippage-preventing portions is formed in one piece, when the present packing case is used as a returnable container, the honeycomb structures-holding plate can be returned in a flat shape (which is a shape before assembling) and, as compared with when conventional packing cases are used, allows for significant reduction in its volume and also reduction in transportation cost.

What is claimed is:

1. A packing case for honeycomb structures, comprising, a case and a honeycomb structures-holding plate accommodated inside the case, the case being constituted in one piece by at least a bottom plate and side plates, the honeycomb structures-holding plate being constituted by a honeycomb structures-holding portion, legs and slippage-preventing portions, the honeycomb structures-holding portion having a plurality of holes for holding honeycomb structures and is provided at about the same height as the vertical-direction center of the side plates of the case in such a manner that the portion is parallel to the bottom plate of the case and abuts against the side plates of the case, the legs being provided at the two opposing sides of the honeycomb structures-holding portion vertically and downward along the side plates of the case facing the two opposing sides, the slippage-preventing portions being provided at the other two opposing sides of the honeycomb structures holding portion vertically and upward along the side plates of the case facing the other two opposing sides, and the case having, at the upper end of each side plate facing each slippage-preventing portion of the honeycomb structures-holding plate, at least one stopper which protrudes toward the inside of the case and whose lower surface abuts against the upper end of each slippage-preventing portion.

2. A packing case for honeycomb structures according to claim 1, wherein the lower ends of the legs are in contact with the bottom plate of the case.

3. A packing case for honeycomb structures according to claim 1, wherein at least part of the upper end of each slippage-preventing portion is at about the same height as the upper ends of the side plates of the case.

4. A packing case for honeycomb structures according to claim 1, wherein the upper surface of the stopper is at the same height as or lower than the upper end of said side plate of the case.

5. A packing case for honeycomb structures according to claim 1, wherein the upper ends of the honeycomb structures held therein are at the same height as or higher than the upper ends of the side plates of the case.

6. A packing case for honeycomb structures according to claim 1, wherein the case is made of a corrugated paper.

7. A packing case for honeycomb structures according to claim 1, wherein the honeycomb structures-holding plate is made of a sheet of corrugated paper in one piece.

* * * * *